US006079475A

United States Patent [19]

Morgan et al.

[11] Patent Number: 6,079,475

[45] Date of Patent: Jun. 27, 2000

[54] SECURITY SCREEN

[75] Inventors: Robert H. Morgan, Stamford, Conn.; Richard Armstrong, Mt. Jewett, Pa.

[73] Assignee: Kane Manufacturing Corporation, Greenwich, Conn.

[21] Appl. No.: 08/608,774

[22] Filed: Feb. 29, 1996

[51] Int. Cl.[7] ..... E06B 9/52

[52] U.S. Cl. ..... 160/371; 52/202; 49/402

[58] Field of Search ..... 160/90, 371, 104; 52/202; 49/402

[56] References Cited

U.S. PATENT DOCUMENTS

| | | | |
|---|---|---|---|
| 2,417,711 | 3/1947 | Smith et al. . | |
| 2,436,277 | 2/1948 | Willet . | |
| 2,446,743 | 8/1948 | Davis | 160/90 |
| 3,194,299 | 7/1965 | Butler | 49/402 X |
| 4,127,156 | 11/1978 | Brandt | 160/371 X |
| 5,461,831 | 10/1995 | Michal | 52/202 X |

OTHER PUBLICATIONS

American National Standard Specifications for Metal Protection Screens (ANSI/SMA 6001–1990).

*Primary Examiner*—Blair Johnson

*Attorney, Agent, or Firm*—St. Onge Steward Johnston & Reens LLC

[57] ABSTRACT

A security screen with a main frame having radial sections which interconnect with radial sections of a subframe when the screen is closed to strengthen the screen and increase its resistance to displacement due to sustained or impact loads. Brackets attached to the radial sections of the main frame have pins aligned to fit into holes in the radial sections of the subframe when the screen is closed. The brackets and pins serve to prevent the radial section of the main frame from bending inward under a force applied to the screen cloth by effectively combining the strength and rigidity of the main frame and subframe. Thus, the force required to displace the screen cloth a given distance is increased. The increase in strength and rigidity is accomplished without increasing the dimensions of the screen or its supporting structure. Also, the brackets serve to inhibit the security screen from being pried open. Other means to interconnect sections of the main frame and subframe are disclosed.

7 Claims, 3 Drawing Sheets

SECURITY SCREEN

FIELD OF THE INVENTION

The invention relates to the field of metal protection screens and, in particular, to screens designed and manufactured for deterring forced entry and vandalism.

BACKGROUND OF THE INVENTION

The Federal Department of Housing and Urban Development (HUD) and its local agencies require installation of security screens for various housing projects throughout the country. The screens are typically installed over windows on the exterior of the first floor to protect the glass from vandalism and to prevent forced entry by intruders.

In order to ensure the effectiveness of the security screens, HUD, in conjunction with the Screen Manufacturer's Association, set minimum specifications (the "SMA Specifications") for, among other things, the ability of security screens to withstand direct impacts, sustained loads and attempts at entry. These specifications and the related definitions have been published as the American National Standard Specifications for Metal Protection Screens (ANSI/SMA 6001-1900) and are herein incorporated by reference.

The most rigorous of the SMA Specifications are for so-called "heavy" screens which are intended to prevent glass breakage and/or to deter forced entry through openings which are easily accessible. The "heavy" standards require in part that, during an impact by an 11 inch ball generating at least 100 lbf-ft (136 N-m) of force, a screen cloth must not stretch more than 3 inches. This distance is measured from the original plane of the screen cloth to the point of maximum displacement and applies to both temporary and permanent deformation. This procedure tests the strength and rigidity of both the screen cloth and the frame. The purpose of the limitation is to prevent breakage of the underlying glass due to objects thrown at the screens and to inhibit forced entry.

Typically, security screens are made with two frames. One frame, called the subframe, is fastened directly to the window opening, usually with bolts or screws. This subframe anchors the screen and prevents it from being removed. Another frame, the main frame, holds the wire cloth and is attached to the subframe with hinges. There is also a lock that is used to secure the main frame to the subframe when closed.

One method to increase a screen's ability to withstand an impact force is to increase the dimensions of the main frame. This is undesirable however because of the increased costs, weight, and line-of-sight of the frame.

Another method comprises springs connecting the screen cloth to the main frame. While a screen of this design can withstand a greater impulse without deforming plastically or tearing, the design does not limit the peak elastic deformation of the screen as required by the SMA Standards.

Another method to strengthen a screen is to provide a rigid support connecting opposite sides of the frame across the screen cloth. However, the drawback of this design is that the support blocks vision and light.

Therefor, what is desired is a means to decrease the permanent and temporary displacement of a screen cloth and its main frame when subject to a force on the screen cloth without increasing the dimensions of the screen cloth or the main frame and without decreasing the amount of area through which light may pass.

SUMMARY OF THE INVENTION

Accordingly, it is an object of the invention to provide a security screen having a mechanism to increase resistance to displacement due to a force applied to the screen cloth.

Another object is to provide a security screen of the above character without increasing the dimensions of the screen cloth or the supporting frame.

Yet another object is to provide a security screen of the above character without decreasing the amount of area through which light may pass.

Still another object is to provide a security screen of the above character wherein the mechanism to increase resistance to displacement also serves to prevent the screen from being pried open.

In one embodiment of the present invention the security screen has a main frame which supports a screen cloth and which includes one or more brackets with pins rigidly attached thereto. The pins are aligned to fit into holes in the subframe when the screen is closed. The pins serve to prevent the section of the main frame from bending inward under a force applied to the screen cloth by supporting the main frame with the subframe when the screen is closed. The brackets and pins effectively combine the strength and rigidity of the main and subframes thereby increasing the force required to displace the screen a given distance. The increase in strength and rigidity is accomplished without increasing the dimensions of the screen or its supporting structure. Also, the brackets serve to inhibit the security screen from being pried open.

The invention and its particular features and advantages will become more apparent from the following detailed description considered with reference to the accompanying drawings.

DETAILED DESCRIPTION OF THE INVENTION

Figure 1:
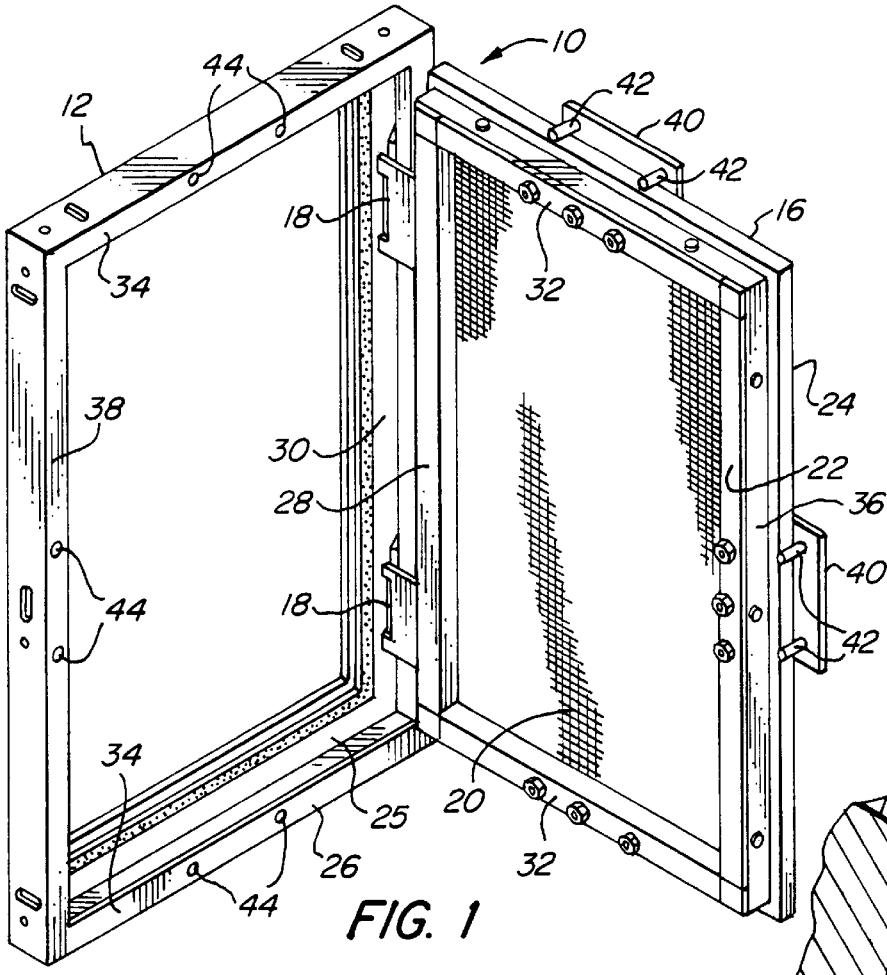
FIG. 1 is an isometric view of the security screen of the present invention showing the screen in an open position.
Figure 2:
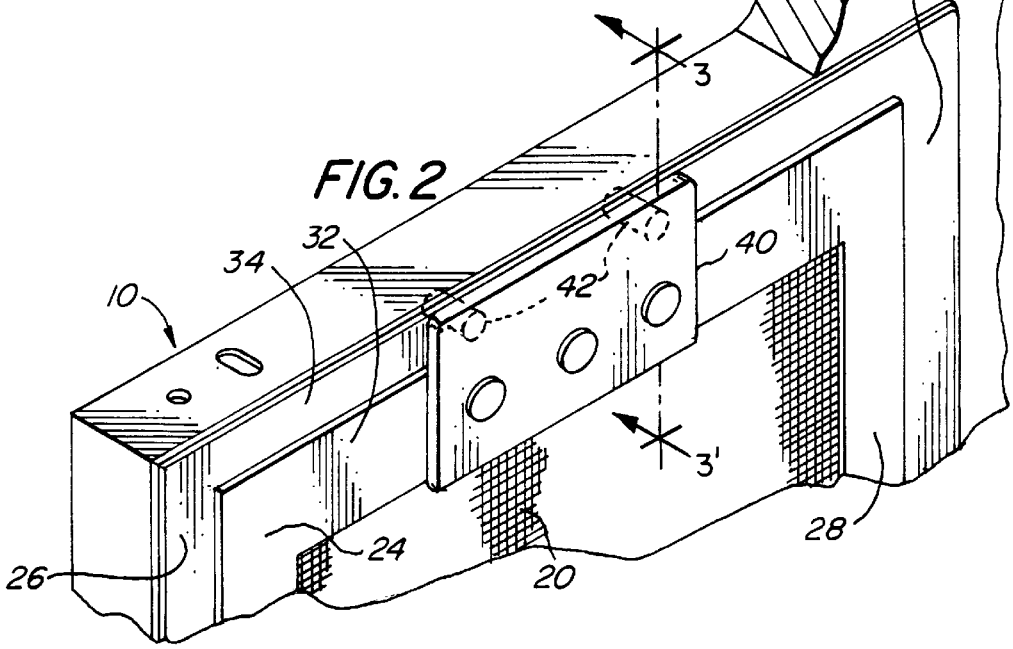
FIG. 2 is a close-up, cut-away isometric view of the security screen of FIG. 1 showing the screen in a closed position.

Referring to FIGS. 1 and 2, the screen 10 of the present invention includes a subframe 12 (which may be attached to a structure 14) and a main frame 16 attached to the subframe 12 by hinges 18. A screen cloth 20, which is substantially planar, is attached to main frame 16. Main frame 16 includes an inside surface 22 and an outside surface 24, and subframe 12 includes an inside surface 25 and an outside surface 26.

Main frame 16 and subframe 12 each include one axial section 28, 30 and two radial sections 32, 34 connected to their respective axial sections 28, 30. Main frame 16 and subframe 12 also each include one latch section 36, 38 attached to their respective radial sections 32,34. Security screen frames usually have four sections, however frames with a different number of sections are also within the contemplation of this invention.

When screen 10 is closed, the outside surfaces 24, 26 of main frame 16 and subframe 12 are substantially aligned, and in one embodiment, are connected by brackets 40. Brackets 40 serve to combine the strength of the main frame 16 and the subframe 12 to make the screen 10 more rigid and to limit the displacement of the screen cloth 20 due to a sustained or temporary, impulse load applied to screen cloth 20. Preferably, brackets connect both sets of radial sections 32, 34 of main frame 14 and subframe 12, however fewer connections are still within the scope of the present invention. Also, latch sections 36, 38 can also be connected. It should be appreciated that, while all the drawings and descriptions may primarily depict and describe connections between the top radial sections of main frame 16 and subframe 12, the bottom radial sections and the latch sections can be similarly connected.

When screen 10 is closed, and is subjected to a sustained or impulse load, the connections between main frame 16 and subframe 12 serve to limit main frame 16 from bending toward the point of impact. This in turn reduces the amount by which screen cloth 20 deflects from its original plane and increases the maximum load which the screen 10 can withstand while remaining within the above-mentioned SMA specifications regarding the maximum displacement of the screen cloth.

The impact test described above tests the strength and rigidity of both the screen cloth 20 and the main frame 16 which supports the screen cloth 20, however, it is the characteristics of the main frame 16 which often determine the performance of the security screen 10 under such conditions. This is so because the forces borne by the screen cloth 20 are only tensile forces and these forces are distributed over many threads having a substantial combined cross-section. The main frame 16 which supports the screen cloth 20 however is subject to shear forces and, more importantly, bending moments which peak at or near the center of the unsupported span of each section of the main frame 16. In prior designs, the bending forces cause the sections the main frame to sag toward the point of impact thereby allowing the screen cloth to deflect, and possibly allowing the screen cloth to deflect a distance greater than that which is allowable under the SMA specifications.

In prior art designs, the bending moments in so me of the sides may be somewhat reduced because the main frame is connected to the subframe by the hinges and possibly by a latch or lock on the opposite side. Thus, the spans of these sides (axial and latch sections) may be divided thereby reducing the length of the unsupported spans of each side and the amount by which these sections bend. However, the other two sides (usually the top and bottom, or radial sections) are not connected to the subframe in prior art designs. In prior designs, the radial sections are supported only at their extremes and are typically the longest unsupported spans of the main frame. With the present invention, these and other spans may be supported when the screen is closed to prevent their sagging or at least reduce it to an acceptable amount.

Figure 3:
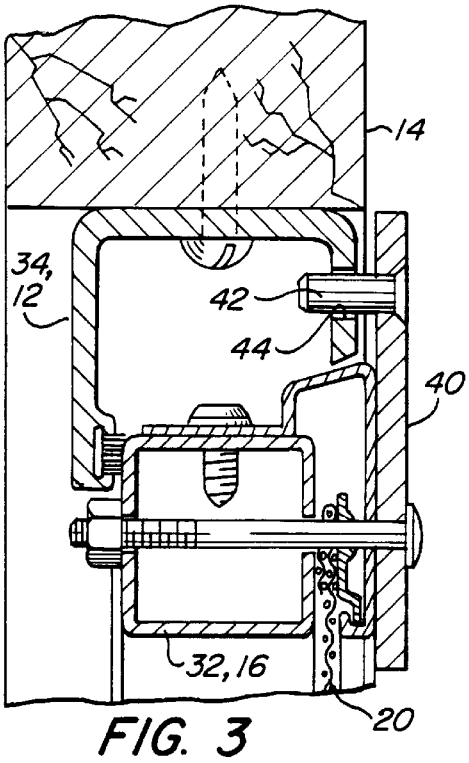
FIG. 3 is a cross-sectional view along line 3–3' of FIG. 2 showing a radial section of the main frame connected to a radial section of the subframe by a pin attached to a bracket which is attached to the main frame.

Referring to FIGS. 1, 2 and 3 brackets 40, rigidly attached to main frame 16 may include pins 42 which are aligned to fit in holes 44 in subframe 12 when screen 10 is closed. Preferably, pins 42 are aligned parallel to a direction of rotation of main frame 16 with respect to subframe 12 (i.e. perpendicular to the radial section 32) so as to optimize the dimensions of holes 44 to ensure a close fit between pin 42 and hole 44 and minimize any "play " therebetween.

Figure 4:
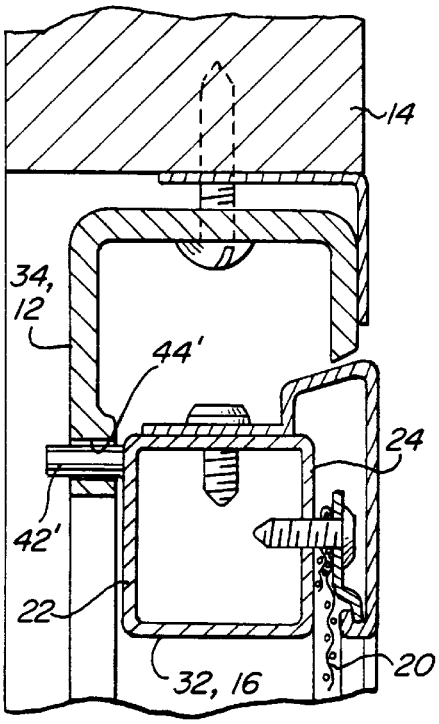
FIG. 4 is a cross-sectional view along 3–3' of FIG. 2 of another embodiment of the security screen of the present invention showing a pin attached to the inside surface of the main frame interfacing with a hole in the subframe.

Referring to FIG. 4, pins 42' may be located on the inside surface 22 of main frame 16, thereby eliminating the use of a bracket. Pins 42' are aligned with holes 44' in subframe 12. As shown in this FIG. 4, screen cloth 20 may be attached to the outside surface 24 of main frame 16, however if, as in this embodiment, pins 42' are attached to the inside surface 22 of main frame 16, preferably screen cloth 20 is also attached to the inside surface 22 of main frame 16 thereby reducing the torsion forces in radial section 32. Torsion of the radial section 32 is undesirable because, as with bending, it increases the displacement of the screen cloth 20.

Figure 5:
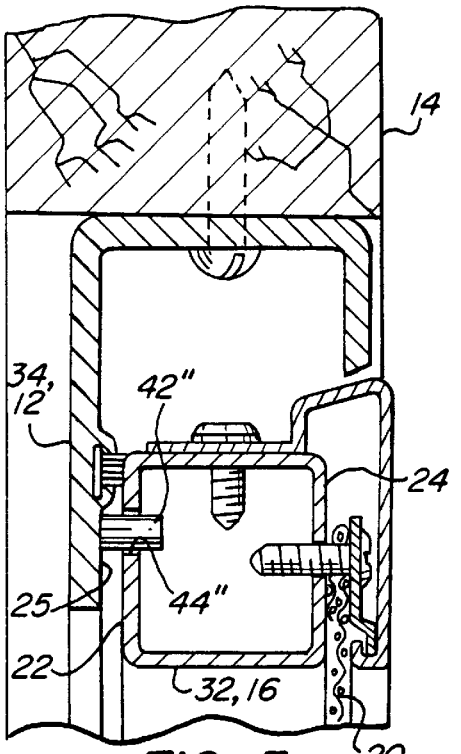
FIG. 5 is a cross-sectional view along 3–3' of FIG. 2 of another embodiment of the security screen of the present invention showing a pin attached to the subframe interfacing with a hole in the inside surface of the main frame.

Referring to FIG. 5, pins 42" may be located on the inside surface 25 of subframe 12 and pin holes 44" may be located on the inside surface 22 of main frame 16. Similar to above, if pins 42" are attached to the inside surface 25 of subframe 16, preferably screen cloth 20 is attached to the inside surface 22 of main frame 16 thereby reducing the torsion forces in radial section 32.

Figure 6:
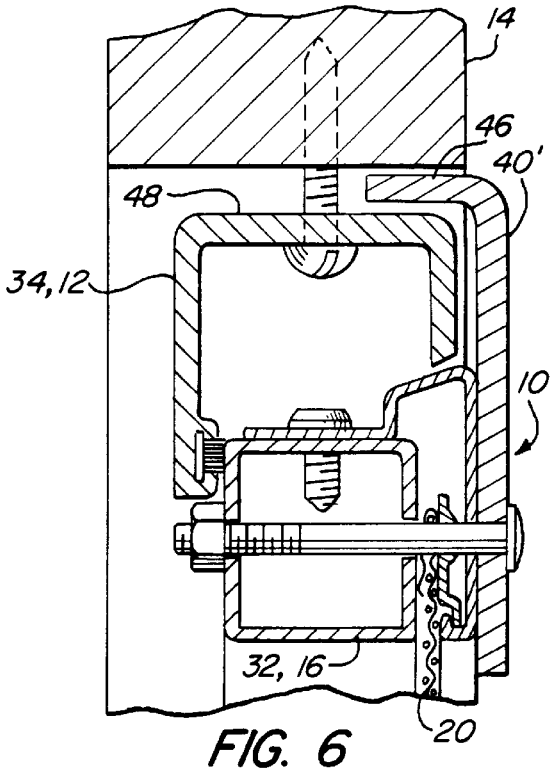
FIG. 6 is a cross-sectional view along 3–3' of FIG. 2 of another embodiment of the security screen of the present invention showing a bracket connected to the main frame that engages the outer periphery of the subframe.

Referring to FIG. 6, bracket 40' may include an elongated portion 46 which, when screen 10 is closed, slides between an outer periphery 48 of subframe 12 and support structure 14. The bracket 40' and elongated portion 46 prevent the radial section 32 from bending toward the point of impact on the screen cloth 20. Thus, the elongated portion 46 and bracket 40' serve to limit the movement of main frame 16 with respect to subframe 12 thereby increasing the rigidity of screen 10 and its resistance to displacement. The elongated portion 46 of bracket 40 also serves to protect subframe 12 and the connection of subframe 12 to the supporting structure 12 from vandalism and prying.

Figure 7:
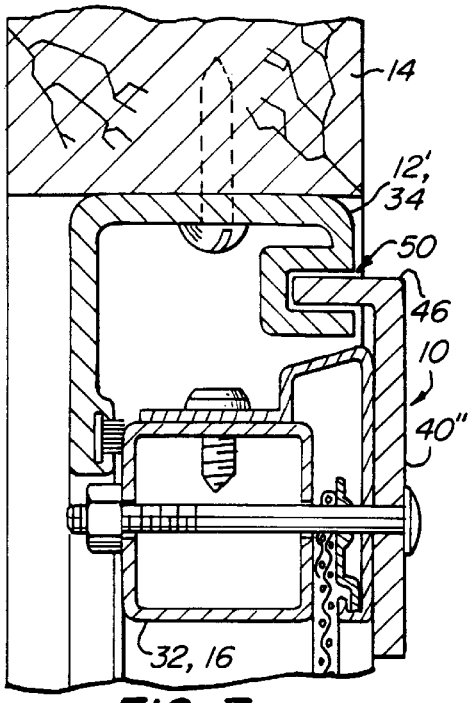
FIG. 7 is a cross-sectional view along 3–3' of FIG. 2 of another embodiment of the security screen of the present invention showing a bracket connected to the main frame which interfaces with an elongated slot in the subframe.

Referring to FIG. 7, subframe 12' may include an elongated slot 50 which is sized and shaped to accept an elongated portion 46 of bracket 40". As above, the bracket 40" and elongated portion 46 prevent the radial section 32 from bending toward the point of impact on the screen cloth 20 thereby increasing the rigidity of screen 10 and its resistance to displacement.

Figure 8:
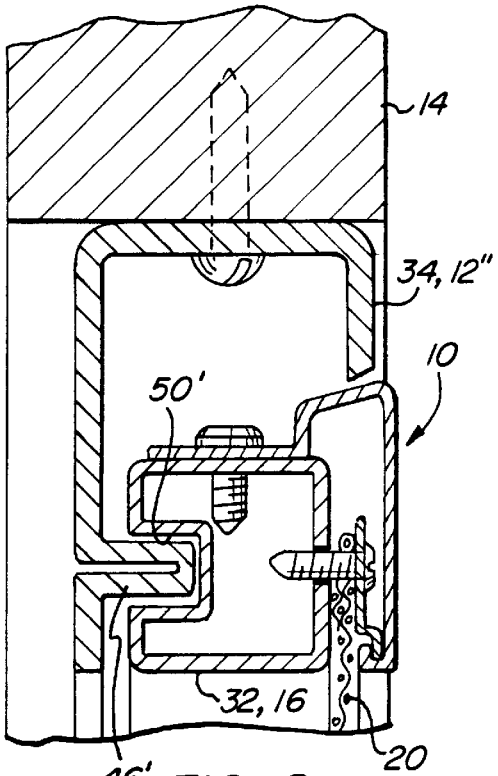
FIG. 8 is a cross-sectional view along 3–3' of FIG. 2 of another embodiment of the security screen of the present invention showing an elongated portion of the subframe which interfaces with an elongated slot in the inside surface of the main frame.

Referring to FIG. 8, main frame 16' may include an elongated slot 50' which is sized and shaped to accept an elongated portion 46' of subframe 12". As above, the radial section 32 is thereby prevented from bending toward the point of impact on the screen cloth 20.

Figure 9:
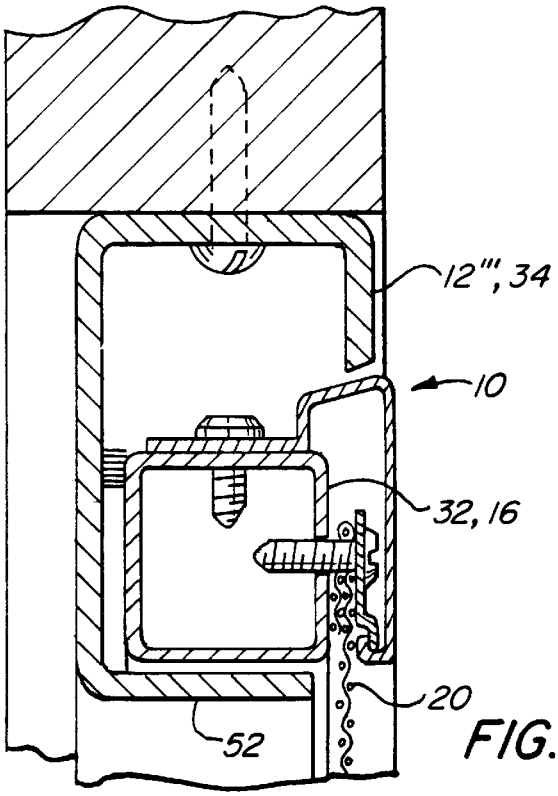
FIG. 9 is a cross-sectional view along 3–3' of FIG. 2 of another embodiment of the security screen of the present invention showing a flange connected to the subframe which is located between a portion of the main frame and a center portion of the screen cloth.

Referring to FIG. 9, subframe 12'" may include flange portion 52 located between a portion of main frame 16 and a center portion (not shown) of screen cloth 20 when screen 10 is closed. Flange 52 serves to support the section of main frame 16 during an impact and to limit the amount which the section bends thereby limiting the amount by which screen cloth 20 deflects.

EXAMPLES

As an example, the following test results illustrate the benefit and effectiveness of the present invention. (It will be recalled that the SMA Specifications test the deflection of the screen due to an impulse load—the maximum deflection of the screen is three

| Test No. | Frame Description | Test Result |
|---|---|---|
| 1 | 1" × 1" Aluminum tube frame, .063 in thick | Failed |
| 2 | 1" × 1" Aluminum tube frame, .090 in thick | Failed |
| 3 | 1" × 1" Steel tube, 16 gauge | Failed |
| 4 | 1" × 1" Steel tube, 11 gauge | Failed |
| 5 | 1½" × 1" Steel tube, 16 gauge on radial sections, 1" × 1", steel tube, 16 gauge on axial sections. | Passed by a small margin |
| 6 | 1" Aluminum tube, .063 in thick with brackets connecting the radial sections of the frames. | Passed easily |

Significantly, in Test No. 6 which incorporated the present invention, the dimensions and material of the frame tubes were substantially the same as those of Test No. 1, which failed. Moreover, the dimensions and material used for the frame tubes in test No. 6 were substantially less rigid than those of Tests 2, 3, 4 and 5, all of which failed or passed only marginally.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A security screen comprising:

a subframe having an axial section and having a radial section connected to said axial section;

a main frame having an axial section and having a radial section connected to said axial section of said main frame, said axial section of said main frame being hingedly connected to said axial section of said subframe;

said security screen having a closed position wherein said main frame fits within said subframe so that an outside surface of said mainframe is flush with an outside surface of said subframe;

a perforated screen attached to said main frame, said screen being aligned with a plane; and means to connect said radial section of said main frame to said radial section of said subframe when said security screen is closed to limit, when a load is placed on said perforated screen, a displacement of said radial section of said main frame with respect to said radial section of said subframe in a direction substantially parallel said plane and to limit a displacement of said perforated screen with respect to said plane;

said means to connect comprising at least one bracket attached to the outside surface of said radial section of said main frame so that the bracket extends over the outside surface of the radial section of the subframe when the security screen is closed, at least one pin extending from the bracket towards the subframe and aligned substantially parallel to a direction of rotation of said main frame with respect to the subframe when said security screen is closed, and said outside surface of said radial section of said subframe having a pin hole aligned to accept said pin when said security screen is closed.

2. A security screen as in claim 1 wherein said perforated screen is attached to the outside surface of said main frame.

3. A security screen as in claim 1 wherein said perforated screen is attached to an inside surface of said main frame.

4. A security screen comprising:

a rectangular subframe having four sections, said four sections of said subframe comprising an axial section, two radial sections connected to said axial section, and a latch section connected to both of said radial sections;

a rectangular main frame having four sections, said four sections of said main frame comprising an axial section, two radial sections connected to said axial section and a latch section connected to both of said radial sections;

said security screen having a closed position;

a perforated screen attached to said four sections of said main frame, said perforated screen being aligned with a plane;

means hingedly connecting said axial sections of said main frame and said subframe and limiting, when a load is placed on said perforated screen, a displacement of said axial section of said main frame with respect to said axial section of said subframe in a direction substantially parallel said plane, and to limit a displacement of said perforated screen in a direction substantially perpendicular said plane;

latch means to interconnect said latch sections of said main frame and said subframe when said security screen is closed, and to limit, when a load is placed on said perforated screen, a displacement of said latch section of said main frame with respect to said latch section of said subframe in a direction substantially parallel said plane, and to limit a displacement of said perforated screen in a direction substantially perpendicular said plane; and means to connect each of said radial sections of said main frame to one of said radial sections of said subframe when said security screen is closed and to limit, when a load is placed on said perforated screen, a displacement of each said radial section of said main frame with respect to said connected radial section of said subframe in a direction substantially parallel said plane, and to limit a displacement of said perforated screen in a direction substantially perpendicular said plane;

wherein said means to connect said radial sections comprises two brackets each rigidly connected to one of said radial sections of said main frame, said brackets having pins extending therefrom, the pins aligned substantially parallel to a direction of rotation of said main frame with respect to the subframe when said security screen is closed, and said radial sections of said subframe having pin holes aligned to accept said pins when said security screen is closed.

5. A security screen comprising:

a rectangular subframe having four sections, said four sections of said subframe comprising an axial section, two radial sections connected to said axial section, and a latch section connected to both of said radial sections;

a rectangular main frame having four sections, said four sections of said main frame comprising an axial section, two radial sections connected to said axial section and a latch section connected to both of said radial sections;

said security screen having a closed position;

a perforated screen attached to said four sections of said main frame, said perforated screen being aligned with a plane; and means hingedly connecting said axial sections of said main frame and said subframe and limiting, when a load is placed on said perforated screen, a displacement of said axial section of said main frame with respect to said axial section of said subframe in a direction substantially parallel said plane, and to limit a displacement of said perforated screen in a direction substantially perpendicular said plane;

latch means to interconnect said latch sections of said main frame and said subframe when said security screen is closed, and to limit, when a load is placed on said perforated screen, a displacement of said latch section of said main frame with respect to said latch section of said subframe in a direction substantially parallel said plane, and to limit a displacement of said perforated screen in a direction substantially perpendicular said plane;

at least one bracket attached to an outside surface of each radial section of said main frame so that the bracket extends over an outside surface of the radial section of the subframe when the security screen is closed, at least one pin extending from the bracket towards the subframe and aligned substantially parallel to a direction of rotation of said main frame with respect to the subframe when said security screen is closed; and a pin hole in the outside surface of each radial section of said subframe aligned to accept said pin when said security screen is closed.

6. A security screen as in claim 5 wherein said perforated screen is attached to the outside surface of said main frame.

7. A security screen as in claim 5 wherein said perforated screen is attached to an inside surface of said main frame.

* * * * *